US009702167B2

(12) United States Patent
Liao

(10) Patent No.: US 9,702,167 B2
(45) Date of Patent: Jul. 11, 2017

(54) ELECTRIC LOCK FOR DOORS

(71) Applicant: Li-Shih Liao, Taoyuan County (TW)

(72) Inventor: Li-Shih Liao, Taoyuan County (TW)

( * ) Notice: Subject to any disclaimer, the term of this patent is extended or adjusted under 35 U.S.C. 154(b) by 305 days.

(21) Appl. No.: 14/532,161

(22) Filed: Nov. 4, 2014

(65) Prior Publication Data

US 2015/0130195 A1 May 14, 2015

(30) Foreign Application Priority Data

Nov. 8, 2013 (CN) ..... 2013 1 0554279

(51) Int. Cl.
*E05C 3/02* (2006.01)
*E05B 47/00* (2006.01)

(52) U.S. Cl.
CPC ..... *E05B 47/0004* (2013.01); *E05B 47/0046* (2013.01); *E05B 2047/0065* (2013.01); *Y10T 292/1043* (2015.04)

(58) Field of Classification Search
CPC ..... E05B 47/0004; E05B 47/0047; E05B 47/023; E05B 47/0607; Y10T 292/68; Y10T 292/702; Y10T 292/1003; Y10T 292/1043; Y10T 292/1044; Y10T 292/1045; E05C 17/44
USPC ..... 292/194
See application file for complete search history.

(56) References Cited

U.S. PATENT DOCUMENTS 6,325,429 B1 * 12/2001 Oxley ..... E05B 47/0047 292/341.16
6,390,520 B1 * 5/2002 Holzer ..... E05B 47/0046 292/341.16
6,942,259 B2 * 9/2005 Marzolf ..... E05B 85/247 292/216
7,021,684 B2 * 4/2006 Orbeta ..... E05B 47/0046 292/201
7,338,097 B2 * 3/2008 Marzolf ..... E05B 63/14 292/11
7,438,335 B1 * 10/2008 Uyeda ..... E05B 47/0046 292/341.15
8,047,585 B1 * 11/2011 Peabody ..... E05B 47/0046 292/340
8,096,594 B2 * 1/2012 Uyeda ..... E05B 47/0046 292/340
2016/0053511 A1 * 2/2016 Peabody ..... E05B 15/022 292/341.15

* cited by examiner

*Primary Examiner* — Mark Williams
(74) *Attorney, Agent, or Firm* — Rosenberg, Klein & Lee

(57) ABSTRACT

An electric lock for doors has a housing with an opening, including a first catch and a second catch, an overlap formed by which enables the operation of the present invention. A blocking element connected to a driving device is displaced between an opening position and a closing position whereby the blocking element would stop the first catch from turning when being in the closing position, therefore controlling the turning of the second catch, rendering the opening a locked status and locking up the latch; when the blocking element is in the opening position, the blocking against the first catch would be eliminated, therefore turning the second catch together and rendering the opening an unlocked status, allowing the latch to be unlocked.

10 Claims, 6 Drawing Sheets

ELECTRIC LOCK FOR DOORS

BACKGROUND OF THE INVENTION

1. Field of the Invention

The present invention relates to a structure of lock, particularly to one that is electrically operated and applied to door locks.

2. Description of the Related Art

Currently the electric locks set on door frames mostly have two sets of corresponding catches inside a housing to form a hedge for a latch to be locked in; meanwhile the two sets of catches are separately connected to a control system to hold control of the opening and closing of the catches. When the lock is locking up, each control system is controlling the connected catches to lock the latch in the hedge; when the lock is unlocking, the control systems are separating the two sets of catches for the latch to leave the hedge.

Furthermore, the conventional electric locks have defects as following. Firstly, with the structures of two control systems, it needs two blocking elements to stop the catches from turning to lock up the latch. The control systems need to operate two blocking elements separately by a solenoid valve in order to eliminate the blocking against the catches so that the catches can turn and unlock the latch to open the door. Such structure is complicated and needs higher costs for production. Also, the two blocking elements need to be operated synchronously; if one of which is malfunctioned, the lock would not be able to operate properly. Secondly, such electric locks usually need higher currents for the solenoid valve to initialize the operation. To avoid the solenoid valve to be overheated, PCB control devices are applied; however, PCB control devices are not durable as the electric locks are, which increases the risks of the locks.

SUMMARY OF THE INVENTION

The primary object of the present invention is to provide an electric lock for doors with simple structure and low rate of malfunction, and one that needs small currents for initiating with no need of PCB control system.

To achieve the object mentioned above, the present invention comprises a housing for installing related components, having a side wall around, on which there is an opening for a latch to enter; a first catch arranged at one side of said housing, having a first inner arm and a first outer arm, the latter of which is near said opening; a second catch arranged at the other side of said housing correspondingly to said first catch, having a second inner arm and a second outer arm; wherein the end of said second inner arm partially overlaps the end of said first inner arm, forming an overlap, and a hedge for locking the latch is formed by said first and second outer arm; a driving device disposed inside said housing and near the first catch, having a driving stick to stick out and withdraw; and a blocking element to be displaced between an opening position and a closing position by said driving stick; whereby the blocking element would stop the first catch from turning when being in the closing position, and the first catch would stop the second catch from turning due to the arrangement of said overlap, rendering the opening a locked status; when the blocking element is in the opening position, it would allow the first catch to turn and control the turning of the second catch as well, rendering the opening an unlocked status.

The present invention further has a first column and a second column arranged symmetrically inside the housing near the inner corners of said opening, and a first positioning hole and a second positioning hole arranged on the first catch and second catch respectively, near the rim of which a first fillister and a second fillister are arranged respectively; the first and second positioning hole are respectively mounted on the first and second column to set the first and second catch inside the housing, and two torsion springs are disposed separately in said first and second fillister with one side thereof separately abutting the vertical edge of corresponding fillister and the other side thereof abutting the side wall to provide the force for the first and second catch to turn back.

Moreover, the present invention has the ends of the first and second inner arm arranged as complementary stairs for overlapping; the outside edges of the first and second inner arm are blocked by the side wall of the housing to prevent from turning inside; and the first and second outer arm each has a chamfer at the end of the inner side thereof for the latch to leave the hedge formed by the first and second outer arm.

In addition, the housing of the present invention has a depression therein arranged behind the first catch for an elastic element to be fixed inside with the top thereof having the blocking element disposed thereon; the blocking element has a holding surface appropriately blocking the rear of the first catch; and the driving device of the present invention is a solenoid valve and further includes a moving block disposed at the end of the driving stick so that it can displace with the operation of the solenoid valve to place the blocking element in the opening or closing position by controlling the pressing on the elastic element. The blocking element further has a dimple hole, and the moving block has a first contact point and a second contact point arranged in opposite direction for the users to select either of which for operation. When the first contact point is selected for operation, the driving stick sticks out to abut the moving block against the blocking element tightly, pressing the elastic element, and it withdraws to loosen the abutting on the moving block and the pressing on the elastic element; when the second contact point is selected for operation, the driving stick sticks out to put the moving block into the dimple hole to loosen the pressing on the elastic element and withdraws to abut moving block and press the elastic element tightly.

The present invention further has inclined surfaces on the inner side of both ends of the side wall near the opening to ensure the first and second catch to turn outside smoothly, and a cover disposed on the housing to avoid dust falling in. Additionally, the present invention includes a control system that can control the operation of the driving device under either electrically connected or disconnected status.

With the end of the second inner arm partially overlaps the end of the first inner arm, the holding surface of the blocking element would block the rear of the first catch to stop it from turning and thus stop the second catch as well when the blocking element is in the closing position. Consequently the latch is locked up in the hedge formed by the first and second catch, achieving the purpose of locking up. When the blocking element is in the opening position, the holding surface thereof leaves the blocking position and the blocking against the first catch is eliminated, enabling the turning of the first catch and the second catch as well, therefore unlocking the latch and achieving the purpose of unlocking. With the disclosed structures, the present invention only needs to control the first catch with one blocking element for operation, which has advantages of simpler structure and smaller volume comparing with a conventional lock; also, it saves energy since it only needs to control the first catch for operation.

DETAILED DESCRIPTION OF THE PREFERRED EMBODIMENT

Figure 1:
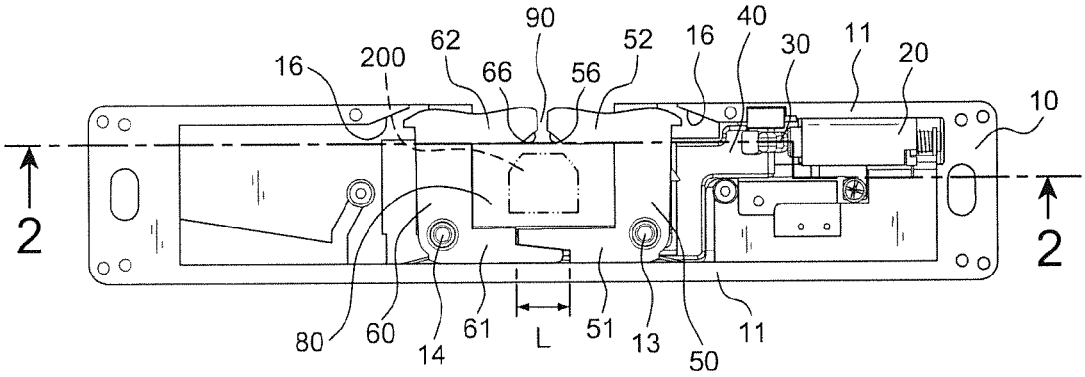
FIG. 1 is a top perspective view of the present invention.
Figure 2:
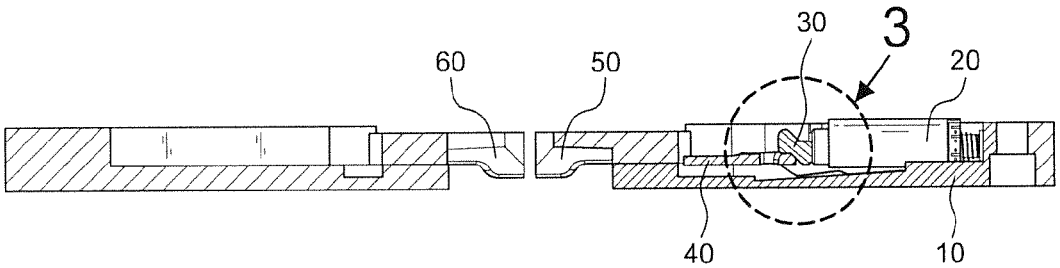
FIG. 2 is a sectional view along line 2-2 in FIG. 1.
Figure 6:
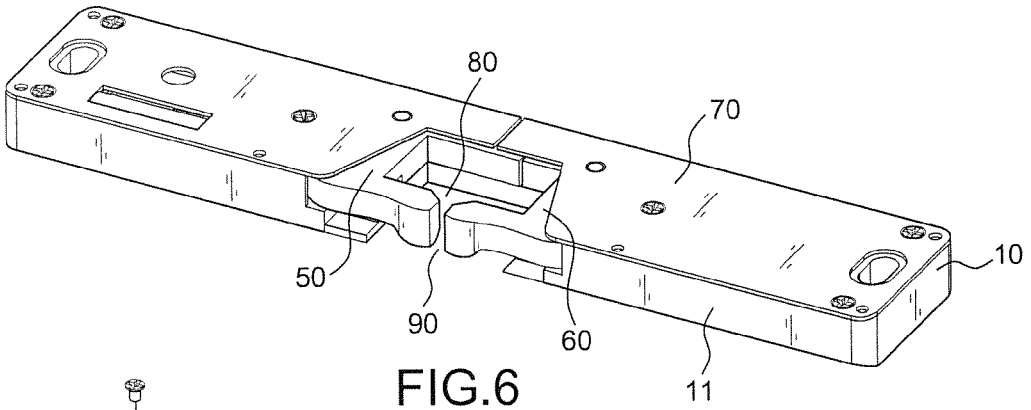
FIG. 6 is a perspective view of the present invention.
Figure 7:
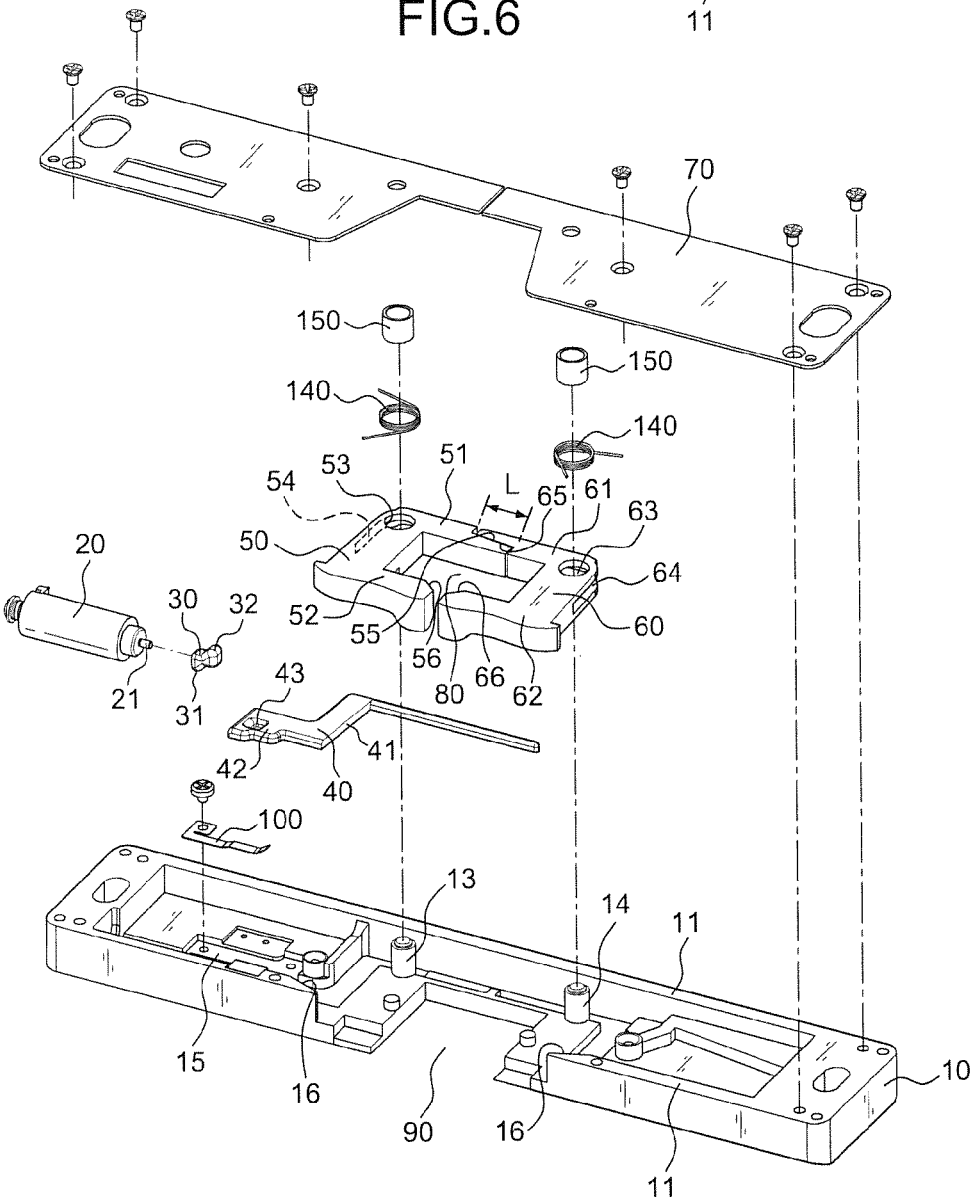
FIG. 7 is an exploded view of the present invention.

Referring to FIGS. 1, 6 and 7, the present invention comprises a housing 10, a driving device 20, a moving block 30, a blocking element 40, a first catch 50, a second catch 60, and a cover 70.

The housing 10 has a side wall 11 surrounding, on which an opening 90 is arranged for a latch 200 to enter; a first column 13 and a second column 14 are arranged symmetrically inside the housing 10 near the inner corners of the opening 90. The cover 70 is disposed on the housing 10 to avoid dust falling in and affect the operation. The first catch 50 has a first inner arm 51, a first outer arm 52, and a first positioning hole 53; near the rim of the first positioning hole 53 a first fillister 54 is arranged. The second catch 60 has a second inner arm 61, a second outer arm 62, and a second positioning hole 63; near the rim of the second positioning hole 63 a second fillister 64 is arranged. The first and second-positioning hole 53, 63 are respectively mounted on the first and second column 13, 14 to set the first and second catch 50, 60 inside the housing respectively and correspondingly on the two sides thereof; wherein the end of the second inner arm 61 partially overlaps the end of the first inner arm 51, forming an overlap L, and a hedge 80 for locking the latch 200 is formed by the first and second outer arm 52, 62. Two torsion springs 140 are disposed separately in the first and second fillister 54, 64, mounted on the first and second column 13, 14 separately by two hollow uprights 150; each torsion spring 140 has one side thereof abutting the vertical edge of corresponding fillister and the other side thereof abutting the side wall 11 to provide the force for the first and second catch 50, 60 to turn back. The driving device 20 is disposed inside the housing 10 near the first catch 50. In this embodiment the driving device 20 is a solenoid valve, having a driving stick 21 to stick out or withdraw by a control system (not shown) for operation under either electrically connected or disconnected status. The moving block 30 is disposed at the end of the driving stick 21 and has a first contact point 31 and a second contact point 32 arranged in opposite direction for the users to select either of which for operation. Furthermore, the housing 10 has a depression 15 arranged therein, behind the first catch 50 for an elastic element 100—in the embodiment, an elastic piece—to be fixed inside, with the top thereof having the blocking element 40 disposed thereon; the blocking element 40 has a holding surface 41 to block the rear 57 of the first catch 50 to stop it from turning, and a contact surface 42 for the first contact point 31 or second contact point 32 thereof to press on. Since the control system (not shown) is controlling the sticking out and withdrawing of the driving stick 21, and the elastic element/elastic piece 100 has the elasticity to be pressed and return, the blocking element 40 is displaced between the closing position as shown in FIGS. 3A, 5A, and 8, and the opening position as shown in FIGS. 3B, 5B, and 9.

Figure 3:
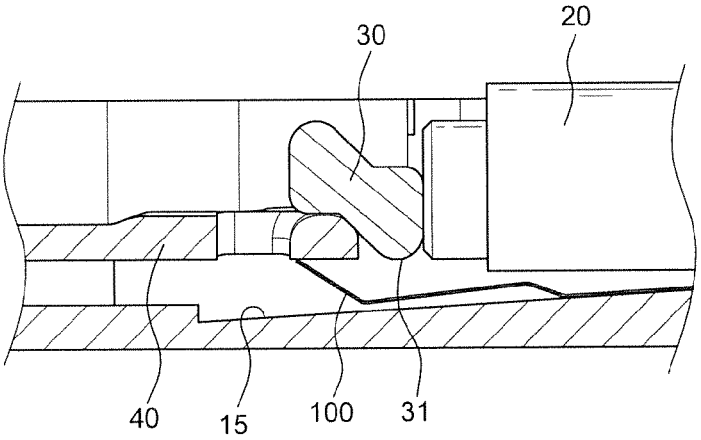
FIG. 3 is an application example of the embodiment as the first contact point being selected for operation.
Figure 3A:
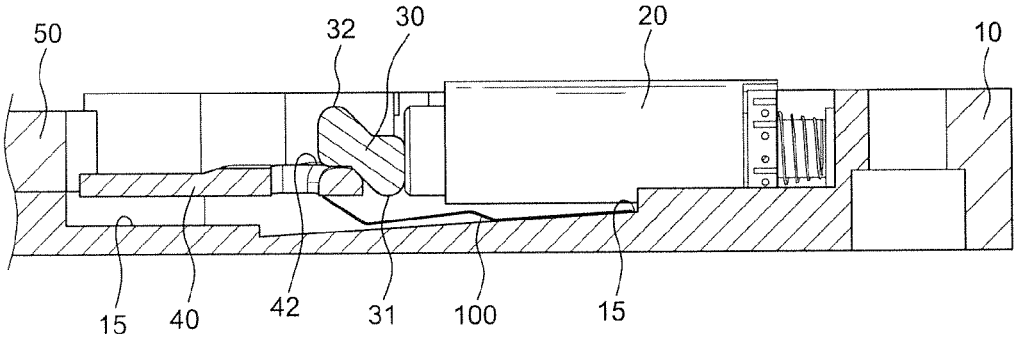
FIG. 3A is an application example of the embodiment illustrating the blocking element in the closing position as the first contact point being selected for operation.
Figure 3B:
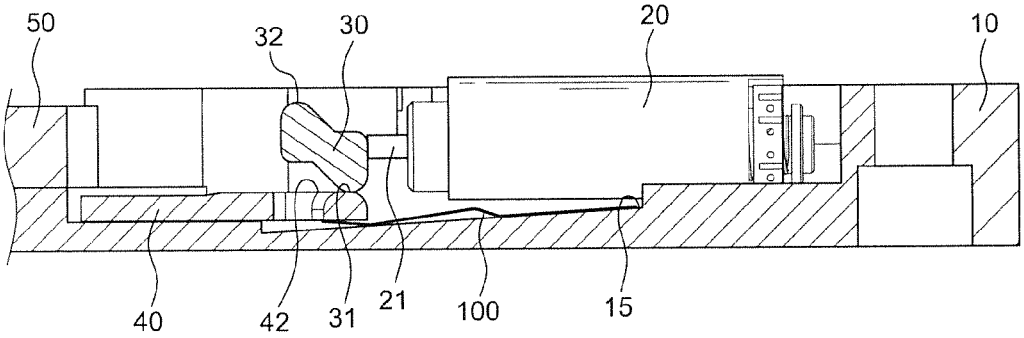
FIG. 3B is an application example of the embodiment illustrating the blocking element in the opening position as the first contact point being selected for operation.
Figure 4:
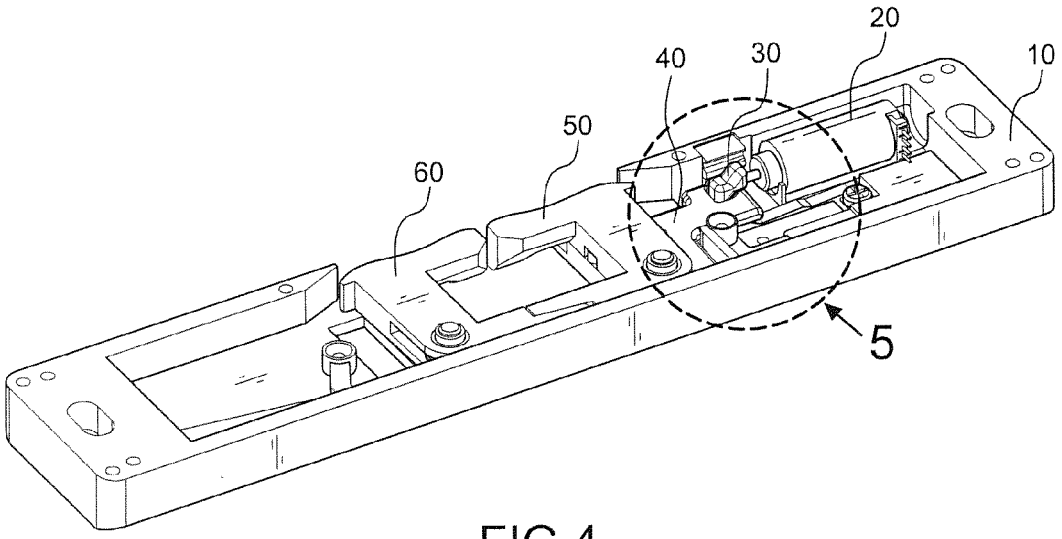
FIG. 4 is a perspective view of the embodiment as the second contact point being selected for operation.

FIGS. 2, 3, 3A, and 3B are application examples of the embodiment with the first contact point 31 being selected for operation. FIG. 3A illustrates the control system (not shown) withdrawing the driving stick 21. In this embodiment, the first contact point 31 is not pressing the contact surface 42 of the blocking element 40. Therefore, the elastic element/elastic piece 100 inside the depression 15 is supporting the blocking element 40 to move upwards, resulting in the holding surface 41 thereof blocking the rear 57 of the first catch 50 and stopping it from turning; in this case, the blocking element 40 is in the closing position. FIG. 3B illustrates the control system (not shown) sticking out the driving stick 21. In this embodiment, the first contact point 31 is pressing on the contact surface 42 of the blocking element 40. The blocking element 40 is therefore moved downwards and the holding surface 41 thereof leaves the blocking position and enables the turning of the first catch 50. In this case, the blocking element 40 is in the opening position.

Figure 5:
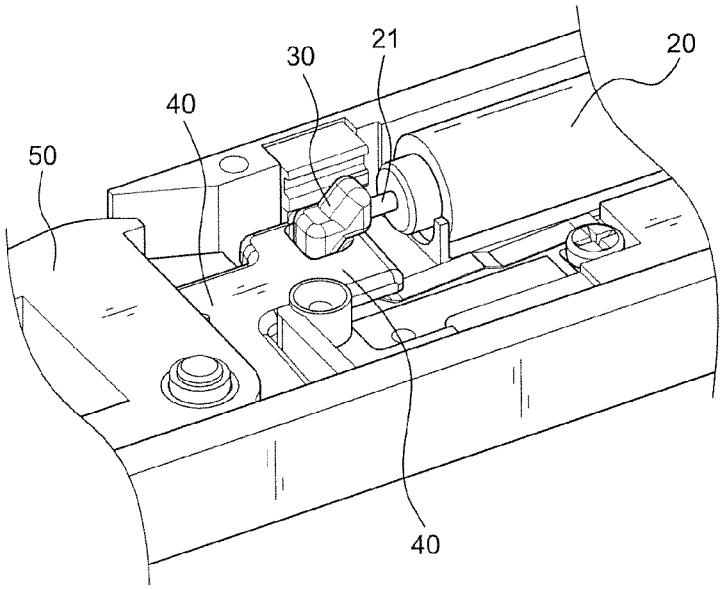
FIG. 5 is a partially enlarged view of the area 5 in FIG. 4.
Figure 5A:
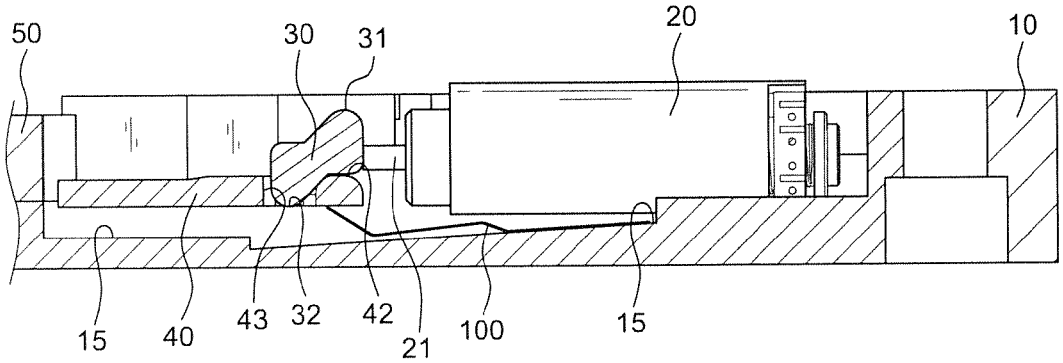
FIG. 5A is an application example of the embodiment illustrating the blocking element in the closing position as the second contact point being selected for operation.
Figure 5B:
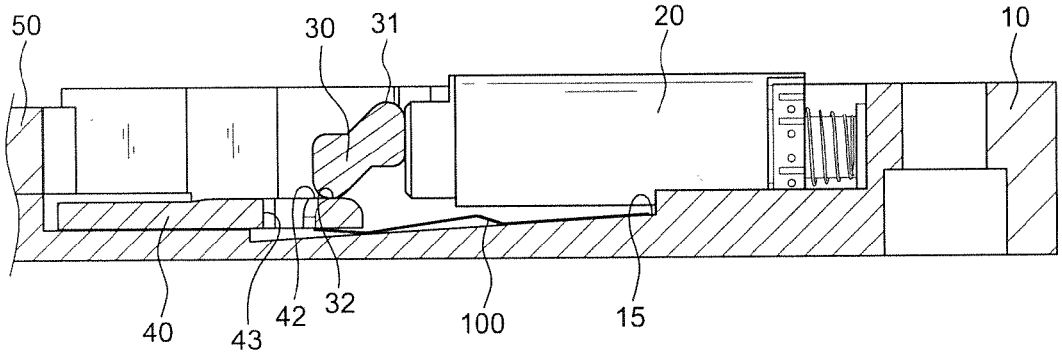
FIG. 5B is an application example of the embodiment illustrating the blocking element in the opening position as the second contact point being selected for operation.

FIGS. 4, 5, 5A and 5B are application examples of the embodiment with the second contact point 32 being selected for operation. FIG. 5A illustrates the control system (not shown) sticking out the driving stick 21. In this embodiment, the blocking element 40 has a dimple hole 43 for the second contact point 32 to be moved therein by the driving stick 21 and stop pressing on the contact surface 42 of the blocking element 40. Therefore, the elastic element/elastic piece 100 inside the depression 15 is supporting the blocking element 40 to move upwards, resulting in the holding surface 41 thereof blocking the rear 57 of the first catch 50 and stopping it from turning; in this case, the blocking element 40 is in the closing position. FIG. 5B illustrates the control system (not shown) withdrawing the driving stick 21. In this embodiment, the driving stick 21 withdraws and results in the second contact point 32 pressing on the contact surface 42 of the blocking element 40, moving it downwards and pressing the elastic element/elastic piece 100 in the depression 15. Therefore, the holding surface 41 leaves the first catch 50 and enables it to turn. In this case, the blocking element 40 is in the opening position.

Figure 8:
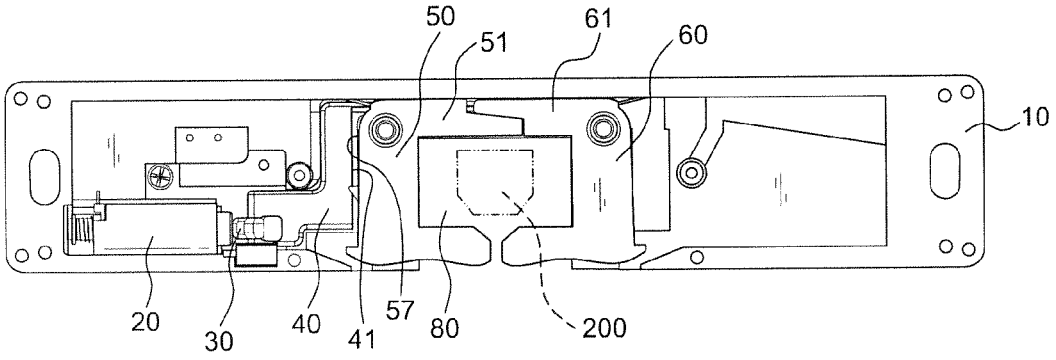
FIG. 8 is a schematic diagram of the present invention as the blocking element being in the closing position.
Figure 9:
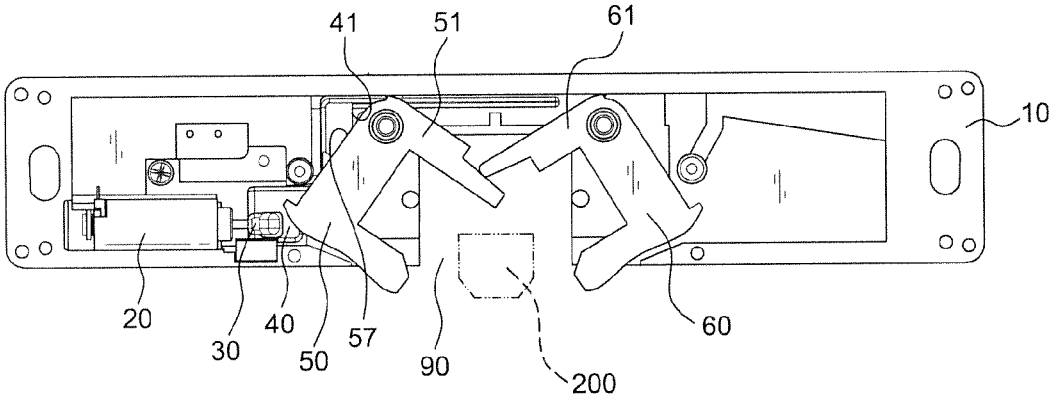
FIG. 9 is a schematic diagram of the present invention as the blocking element being in the opening position.

FIG. 8 illustrates the blocking element 40 being in the closing position. The holding surface 41 thereof is blocking the rear 57 of the first catch 50 to stop it from turning and thus stop the second catch 60 as well. Consequently the latch 200 is locked up in the hedge 80 formed by the first and second catch 50, 60, achieving the purpose of locking up.

FIG. 9 illustrates the blocking element 40 being in the opening position. The holding surface 41 thereof leaves the blocking position and the blocking against the first catch 50 is eliminated, enabling the first catch 50 to turn and the second catch 60 as well, and unlocking the latch, achieving the purpose of unlocking.

Further referring to FIGS. 1 and 7, in this embodiment, the overlap L formed by the first inner arm 51 and the second inner arm 61 is arranged as complementary stairs. The first inner arm 51 has a first rabbet 55 engaging a second rabbet 65 of the second inner arm 61 to form a level edge, but the present invention is not limited to such structure. The structure of complementary stairs can reduce the thickness of the overlap L and the volume of the present invention. In addition, the first and second inner arm 51, 61 are blocked by the side wall 11 of the housing 10 to prevent from turning inside; and the first and second outer arm 52, 62 each has a chamfer 56/66 at the end of the inner side thereof for the latch 200 to leave the hedge 80. In this embodiment the present invention further has inclined surfaces 16 on the inner side of both ends of the side wall 11 near the opening 90 to ensure the first and second catch 50, 60 to turn outside smoothly.

In this embodiment the control system (not shown) can control the driving device 20 to operate under either electrically connected or disconnected status. It can be a switch, a processor, or a computer. When opening the door, the control system (not shown) would electrically connect or disconnect the driving device 20 to stick out or withdraw the driving stick 21 in order to move the blocking element 40 in the opening position; consequently the latch 200 leaves the hedge 80 and the door is opened.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An electric lock for doors comprising:

a housing having an opening on a side wall thereof for a latch to enter;

a first catch arranged in a first portion of said housing, the first catch having a first inner arm and a first outer arm, the first outer arm arranged near said opening;

a second catch arranged in a second portion of said housing correspondingly to said first catch, the second catch having a second inner arm and a second outer arm, an end of said second inner arm partially overlapping an end of said first inner arm to form an overlap, a hedge for locking the latch formed by said first and second outer arms;

a driving device disposed inside said housing and near the first catch, the driving device having a driving stick to protrude and withdraw; and a blocking element displaceable between an opening position and a closing position by said driving stick;

whereby the blocking element, when in the closing position, prevents rotation of the first catch toward an open position thereof, the first catch thereby preventing rotation of the second catch toward an open position thereof due to the arrangement of said overlap, the opening thereby placed in a locked status without the blocking element contacting the second catch; and whereby the blocking element, when in the opening position, allows rotation of the first catch toward the open position thereof, the first catch thereby allowing rotation of the second catch toward the open position thereof, the opening thereby placed in an unlocked status.

2. The electric lock for doors as claimed in claim 1, further comprising:

a first column and a second column arranged symmetrically inside the housing near inner corners of said opening;

a first positioning hole and a second positioning hole respectively arranged on said first catch and second catch;

a first fillister and a second fillister respectively arranged near a rim of said first positioning hole and second positioning hole; and a first torsion spring and a second torsion spring respectively arranged in said first and second fillister, one side of each of the torsion springs separately abutting a vertical edge of the corresponding fillister, an other side of each torsion spring abutting the side wall, wherein the first and second positioning hole are respectively mounted on the first and second column to set the first and second catch inside the housing, and the torsion springs provide respective forces to rotate the first and second catch to respective closed positions.

3. The electric lock for doors as claimed in claim 1, wherein the overlapping ends of the first and second inner arm are arranged as complementary stairs.

4. The electric lock for doors as claimed in claim 3, wherein the the first and second catches are blocked from rotating beyond their respective closed positions by the side wall of the housing contacting outside edges of the first and second inner arms.

5. The electric lock for doors as claimed in claim 1, wherein each of the first and second outer arms has a chamfer at the end of an inner side thereof.

6. The electric lock for doors as claimed in claim 1, wherein:

the housing has a depression therein arranged behind the first catch, an elastic element fixed inside said depression, a top of said elastic element having the blocking element disposed thereon;

the blocking element is appropriately blocking the first catch; and the driving device is a solenoid valve and further includes a moving block disposed at the end of the driving stick, the moving block linearly displaceable with the operation of the solenoid valve to place the blocking element in the opening or closing position by controlling a pressure on the elastic element.

7. The electric lock for doors as claimed in claim 6, wherein:

the moving block has a first contact point and a second contact point arranged on opposite portions thereof, and the blocking element further has a dimple hole;

when the first contact point is selected for operation, the driving stick protrudes to abut the moving block against the blocking element tightly and thereby apply the pressure to the elastic element, and the driving stick withdraws to loosen the abutting on the moving block and the pressure on the elastic element; and when the second contact point is selected for operation, the driving stick protrudes to move the moving block into the dimple hole to loosen the pressure on the elastic element and the driving stick withdraws to move the moving block from the dimple hole and thereby apply the pressure to the elastic element.

8. The electric lock for doors as claimed in claim 1, further comprising a control system configured to control the operation of the driving device under either electrically connected or disconnected status.

9. The electric lock for doors as claimed in claim 1, wherein the side wall has inclined surfaces on an inner side of both ends surrounding the opening.

10. The electric lock for doors as claimed in claim 1, further comprising a cover disposed on the housing.

* * * * *